US010148002B2

(12) United States Patent
McGough et al.

(10) Patent No.: US 10,148,002 B2
(45) Date of Patent: Dec. 4, 2018

(54) HORIZONTALLY-POLARIZED ANTENNA FOR MICROCELL COVERAGE HAVING HIGH ISOLATION

(71) Applicant: Cisco Technology, Inc., San Jose, CA (US)

(72) Inventors: Erin P. McGough, Akron, OH (US); Daniel N. Johnson, Richfield, OH (US); Thomas G. Lutman, Berlin Center, OH (US); Fred J. Anderson, Lakeville, OH (US)

(73) Assignee: Cisco Technology, Inc., San Jose, CA (US)

( * ) Notice: Subject to any disclaimer, the term of this patent is extended or adjusted under 35 U.S.C. 154(b) by 4 days.

(21) Appl. No.: 15/297,008

(22) Filed: Oct. 18, 2016

(65) Prior Publication Data

US 2017/0324153 A1 Nov. 9, 2017

Related U.S. Application Data

(60) Provisional application No. 62/333,486, filed on May 9, 2016.

(51) Int. Cl.
*H01Q 21/00* (2006.01)
*H01Q 1/24* (2006.01)
(Continued)

(52) U.S. Cl.
CPC ..... *H01Q 1/246* (2013.01); *H01Q 1/2291* (2013.01); *H01Q 1/521* (2013.01); *H01Q 7/00* (2013.01); *H01Q 9/0421* (2013.01); *H01Q 21/24* (2013.01); *H01Q 21/28* (2013.01); *H01Q 21/30* (2013.01)

(58) Field of Classification Search
CPC .... H01Q 9/0407; H01Q 9/0435; H01Q 9/265; H01Q 9/0464; H01Q 7/00; H01Q 21/205; H01Q 21/24; H01Q 21/065; H01Q 21/28; H01Q 21/30
See application file for complete search history.

(56) References Cited

U.S. PATENT DOCUMENTS 7,953,406 B2 5/2011 Itamiya et al.
8,269,682 B2 9/2012 Su
(Continued)

*Primary Examiner* — Dameon E Levi
*Assistant Examiner* — Ricardo Magallanes
(74) *Attorney, Agent, or Firm* — Patterson + Sheridan, LLP

(57) ABSTRACT

The embodiments herein use polarization diversity between antennas where the antennas for one cell are, e.g., horizontally polarized and antennas for the other cell are vertically polarized. In one embodiment, the antennas for a macro cell are vertically polarized while micro cell antennas are horizontally polarized. In one example, the micro cell antennas are printed antennas that form a loop that is co-planar with the magnetic fields generated by the macro cell antennas when transmitting. Because the magnetic fields are co-planar (rather than orthogonal) to the current flowing through the loop in the micro cell antenna, the effect of the electromagnetic signals emitted by the macro cell antenna is reduced. This may permit dual radio network devices to have improved performance when operating simultaneously—e.g., when the macro cell radio is transmitting and the micro cell radio is receiving at or near the same frequency band.

20 Claims, 9 Drawing Sheets

(51) Int. Cl.

| | |
|---|---|
| ***H01Q 7/00*** | (2006.01) |
| ***H01Q 21/24*** | (2006.01) |
| ***H01Q 9/04*** | (2006.01) |
| ***H01Q 21/28*** | (2006.01) |
| ***H01Q 1/52*** | (2006.01) |
| ***H01Q 21/30*** | (2006.01) |
| ***H01Q 1/22*** | (2006.01) |

(56) References Cited

U.S. PATENT DOCUMENTS

| | | | | |
|---|---|---|---|---|
| 9,191,082 | B2 | 11/2015 | Choi et al. | |
| 2008/0111757 | A1* | 5/2008 | Bisiules | H01P 5/103 343/799 |
| 2012/0013521 | A1* | 1/2012 | Saliga | H01Q 9/0407 343/860 |
| 2012/0056790 | A1* | 3/2012 | Lee | H01Q 7/00 343/702 |
| 2016/0227274 | A1 | 8/2016 | Oh et al. | |

* cited by examiner

HORIZONTALLY-POLARIZED ANTENNA FOR MICROCELL COVERAGE HAVING HIGH ISOLATION

CROSS-REFERENCE TO RELATED APPLICATIONS

This application claims the benefit of U.S. provisional patent application Ser. No. 62/333,486, filed May 9, 2016, which is incorporated herein by referenced in its entirety.

TECHNICAL FIELD

Embodiments presented in this disclosure generally relate to antennas for dual-radio network devices, and more specifically, to antenna design for high isolation between antennas for different radios.

BACKGROUND

Current wireless access points (APs) allow for simultaneous operation in different bands (e.g., one in the 2.4 GHz band and one in the 5 GHz band). However, previously available APs experience highly degraded performance when two co-located radios operate within the same band (e.g., two radios operating in the 5 GHz band). The reason for this is that when one radio is transmitting in close proximity to another radio that is receiving, packet reception is degraded by interference and throughput scaling is not achieved.

Radio hardware is designed to operate over a wide frequency range in a particular band (e.g., channels in the 5 GHz band). As such, receivers have gain and signal detection circuitry over the entire band. If one co-located and same-band radio transmits a high power signal, that signal can overdrive the other radio when it is receiving due to close physical and spectral proximity of the radios. As a result, the receiving radio may lose any packets that the radio is currently decoding. This results in a loss of potential throughput and a "sharing" of the air time between the radios.

The second issue that limits the same band operation of co-located radios is excessive transmitter noise floor that exists in integrated circuits manufactured using currently available silicon processing technology. Currently available integrated circuits and associated hardware have limited out-of-band noise transmission using limited filtering capabilities which reduce baseband noise. The transmitter noise floor affects the entire band of operation and can limit the signal-to-noise-plus-interference-ratio (SINR) of the radios and in turn limit the range of radios. This noise can increase the received signal's SINR greater than what that packet modulation can accept, and as a result, the received packet may be lost.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DESCRIPTION OF EXAMPLE EMBODIMENTS

Overview

Figure 1:
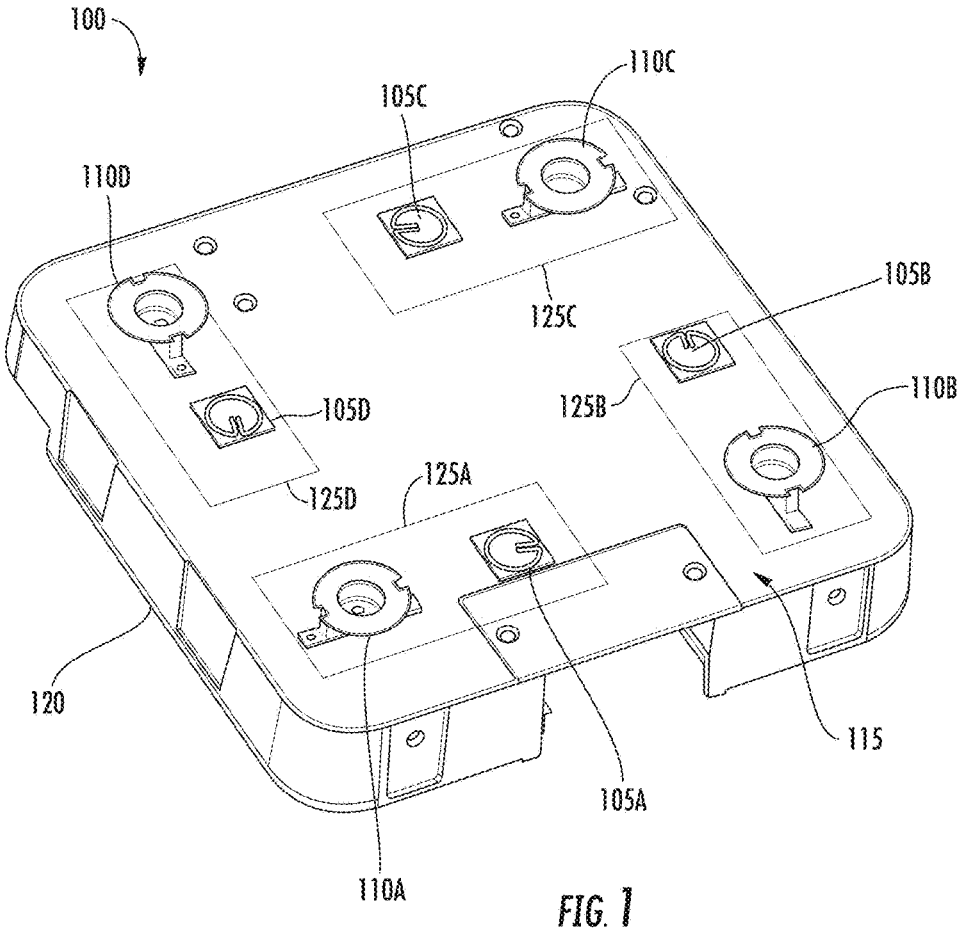
FIG. 1 illustrates antennas for a dual-radio network device, according to one embodiment described herein.

One embodiment presented in this disclosure is a network device that includes a chassis, a first antenna disposed in the chassis and coupled to a first radio, and a second antenna disposed in the chassis and coupled to a second radio. Further, the first antenna has a first polarization and comprises a conductive loop coupled at two ends to respective strips of a strip slot, wherein the strip slot extends from the loop to a center of the first antenna. Moreover, the second antenna has a second polarization different from the first polarization.

Another embodiment presented in this disclosure is a network device that includes a chassis, a first plurality of antennas disposed in the chassis and coupled to a first radio, and a second plurality of antennas disposed in the chassis and coupled to a second radio. Each of the first plurality of antennas comprises a conductive loop coupled at two ends to respective strips of a strip slot where the strip slot extends from the loop to a center of a respective one of the first plurality of antennas. Each of the second plurality of antennas comprises a planar table portion disposed along a first plane and a bucket coupled to the planar table portion, wherein the bucket extends in a direction perpendicular to the first plane.

Another embodiment presented in this disclosure is a network device that includes a chassis, a first plurality of antennas disposed in the chassis and coupled to a first radio, and a second plurality of antennas disposed in the chassis and coupled to a second radio. Each of the first plurality of antennas comprises a conductive loop coupled at two ends to respective strips of a strip slot where the strip slot extends from the loop to a center of a respective one of the first plurality of antennas. Each of the second plurality of antennas is a transverse magnetic 20 mode patch antenna.

EXAMPLE EMBODIMENTS

A dual-radio network device (e.g., an access point, router, etc.) contains two different radios that are coupled to respective antennas co-located on the network device. In one embodiment, the radios transmit on the same band (e.g., the 5 GHz frequency band) which may mean the electromagnetic signals emitted by the antenna for one radio can interfere with an antenna for another radio as described above. Further, even if the radios transmit on different bands (e.g., one radio operates at 2.4 GHz while the other radio operates at 5 GHz), the emitted electromagnetic signals can interfere with the radio in the network device because of the close proximity of the antennas on the network device.

In one embodiment, the interference between the radios in the network device can be mitigated by using a "macro-micro" cell approach. In one embodiment, different relative coverage area sizing of the co-located same-band radios results in one of the radios being less susceptible to the artificial noise floor generated from the other radio. This approach creates two concentric circles of coverage around an AP that are described as "micro" and "macro" coverage areas that can both serve clients in an un-interfered manner. Reducing the coverage area size of one of the co-located same-band radios relative to the other coverage area size results in one of the radios having lower transmitter power (e.g., lower interference relative to the other radio) which increases the isolation between the micro and micro cells.

To further improve isolation between the antennas establishing the micro and macro cells, the embodiments herein use polarization diversity between antennas where the antennas for one cell are horizontally polarized and antennas for the other cell are vertically polarized. In one embodiment, the antennas for the macro cell (i.e., the macro cell antenna) are vertically polarized while the micro cell antennas are horizontally polarized. In one example, the micro cell antennas are printed antennas that form a loop that is co-planar with the magnetic fields generated by the macro cell antennas when transmitting. Because the magnetic fields are co-planar (rather than orthogonal) to the current flowing through the loop in the micro cell antenna, the effect of the electromagnetic signals emitted by the macro cell antenna is reduced. This may permit the dual radios to have improved performance when operating simultaneously—e.g., when the macro cell radio is transmitting but the micro cell radio is receiving.

FIG. 1 illustrates antennas for a dual-radio network device 100, according to one embodiment described herein. The network device 100 (e.g., an AP or router) includes a chassis 120 with two different types of antennas: micro cell antennas 105 and macro cell antennas 110. Although not shown here, the micro cell antennas 105 are coupled to a micro cell radio while the macro cell antennas 110 are coupled to a macro cell radio. In one embodiment, the micro and macro cell radios operate in the same band (e.g., both operate at 2.4 GHz or 5 GHz). In another embodiment, the radios operate in the same band during a first time period but different bands in a second time period. For example, both the micro and macro cell radios operate in 5 GHz but then the network device 100 switches the macro cell radio to operate in the 2.4 GHz band. The macro and micro cell radios may operate simultaneously regardless of whether the radios operate in the same band or different bands. Thus, a high level of isolation between the micro cell antennas 105 and the macro cell antennas 110 is desired.

The locations of the antennas 105, 110 on a ground plane 115 of the network device 100 affect their isolation. In this example, each one of the micro cell antennas 105 is grouped with a respective one of the macro cell antennas 110 to form pairs 125A-D. In this example, the micro cell antenna 105A is closer to the macro cell antenna 110A than to all the other macro cell antennas 110B-D. For example, the micro cell antenna 105A may be approximately 40-60 mm from the macro cell antenna 110 in a pair 125. As described in detail below, the antennas in the pairs 125 have different polarizations which result in polarization separation between the antennas in each of the pairs 125.

The larger physical distance between antennas in the different pairs 125 results in physical separation which increases the isolation between the antennas. That is, micro cell antenna 105A is closer to macro cell antenna 110A than to macro cell antenna 1106. When both of the macro cell antennas 110A and 1106 are transmitting, the polarization separation between macro cell antenna 110A and the micro cell antenna 105A is the primary reason the emitted electromagnetic waves do not affect the micro cell radio. However, although polarization separation may also reduce the effect the macro cell antenna 1106 has on micro cell antenna 105A, another reason that the macro cell antenna 1106 is isolated from antenna 105A is because of the physical separation between these antennas. In this manner, the micro cell and macro cell antennas 105, 110 can be arranged on the ground plane 115 (e.g., a common plane) and achieve high isolation relative to each other.

Although the embodiments herein describe using a macro cell and micro cell approach to increase isolation between the cells, this is not a requirement. That is, instead of the coverage area established by the micro cell antennas 105 being surrounded by the coverage area established by the macro cell antennas 110, the micro cell antennas 105 may have substantially the same or greater coverage areas than the macro cell antennas 110. That is, the embodiments described herein can improve isolation between the antennas 105, 110 regardless if the coverage area of the micro cell antennas 105 is contained within the coverage area of the macro cell antennas 110.

Figure 2:
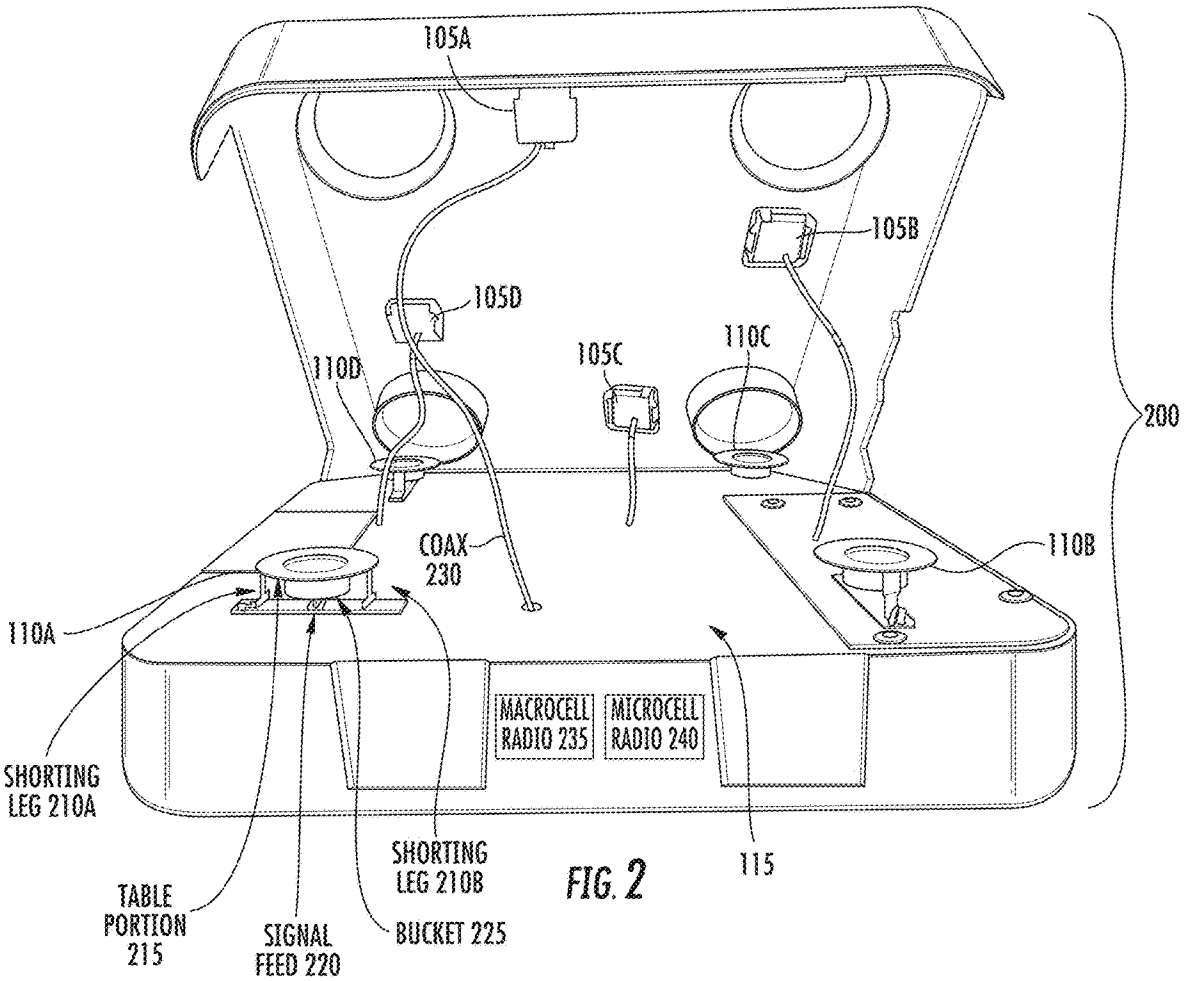
FIG. 2 illustrates antennas for a dual-radio network device, according to one embodiment described herein.

FIG. 2 illustrates antennas for the dual-radio network device 100, according to one embodiment described herein. As shown, the network device 100 has a chassis 200 that includes a radome which provides a cover for the ground plane 115. In one embodiment, the radome establishes an outer surface of a form factor of the network device 100 which covers the antennas 105, 110.

In this embodiment, the micro cell antennas 105 are coupled to the radome using snap-in features built into the radome while the macro cell antennas 110A are coupled to the ground plane 115 using screws or rivets. The micro cell antennas 105 are coupled to a micro cell radio 240 using respective coaxial cables 230. As described in more detail below, the coaxial cables 230 include center conductors and shielding conductors for transmitting signals between the micro cell antennas 105 and the micro cell radio 240.

Each of the macro cell antennas 110 is communicatively coupled to a macro cell radio 235. In this example, the macro cell antenna 110 is a transverse magnetic 20 ($TM_{20}$) mode patch antenna that includes a bucket 225 extending from a planar table portion 215. The bottom of the bucket 225 is coupled to a signal feed 220 which is insulated from the ground plane 115 and couples the antenna 110 to the macro cell radio 235. The macro cell antenna 110 also includes two shorting legs 210 which extend from the table portion 215 to the ground plane 115. Moreover, the shorting legs are 210 are coupled at diametrically opposed locations on the table portion 215. As used herein, diametrically opposed means the shorting legs 210 are coupled at locations along the circumference of the circular table portion 215 that are around 170-190 degrees from each other.

In one embodiment, the macro cell radio 235 operates in different bands—e.g., 2.4 GHz and 5 GHz by transmitting and receiving signals using the macro cell antennas 110B. In one embodiment, the micro cell radio 240 may operate only in one band—e.g., 5 GHz. Operating only at 5 GHz allows the micro cell antenna 105 to be placed physically closer to the ground plane 115 than would be possible if, for example, the micro cell antennas 105 operated in the 2.4 GHz band which means the height of the radome can be reduced.

Although the 5 GHz band is specifically mentioned, the design of the micro cell antennas 105 facilitates communication in any band between 4-6.5 GHz. Moreover, the design of the macro cell antennas 110 facilitates communication in any band between 2.2-6.5 GHz. Although not shown, the network device 100 may include a control system that includes any number of processors and memory for controlling the function and operation of the micro and macro cell radios. For example, the control system may include hardware, firmware, or software for determining when to switch the macro cell radio and macro cell antenna to operate in a different frequency band.

In one embodiment, if there is too much congestion or interference on the 5 GHz band, the macro cell radio 235 may switch to the 2.4 GHz band. In other examples, the macro and micro cells may be used to provide other services besides Wi-Fi at 2.4 GHz and 5 GHz such as WiMAX, Bluetooth communication, cell network coverage (e.g., long term evolution (LTE)), etc.

Figure 3:
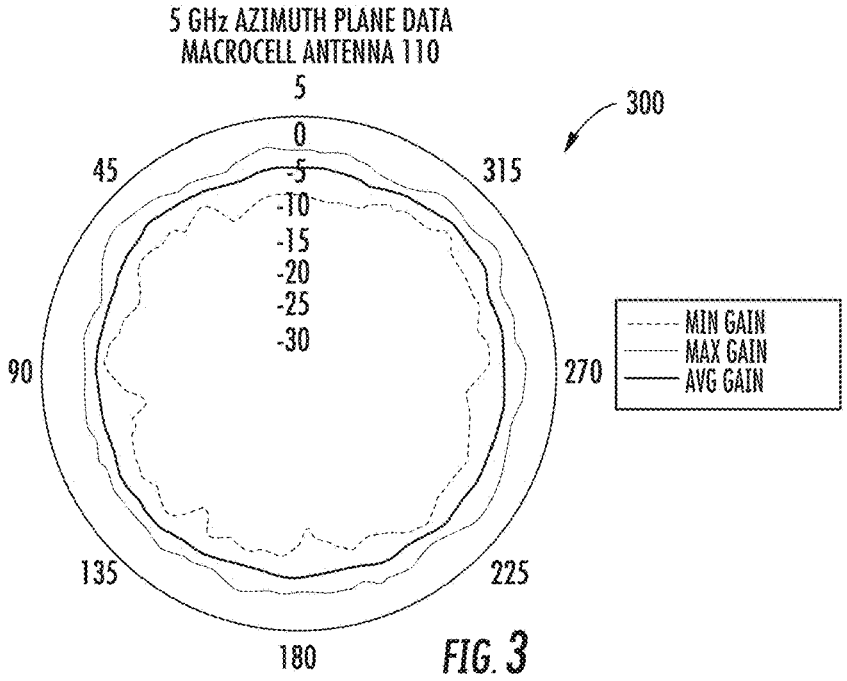
FIG. 3 illustrates the radiation pattern of a macro cell antenna along the azimuth plane, according to one embodiment described herein.

FIG. 3 illustrates the radiation pattern 300 of a macro cell antenna 110 along the azimuth plane, according to one embodiment described herein. The radiation pattern 300 illustrates the min, max, and average gain of the antenna 110 along the azimuth plane that is parallel to the ground plane 115 shown in FIGS. 1 and 2. Thus, if the network device were mounted on a ceiling such that the ground plane 115 is in a facing relationship with the floor, the azimuth plane is co-planar with the ceiling.

As shown, the radiation pattern 300 is essentially omnidirectional in the azimuth plane to provide an even coverage area in all directions along the azimuth plane. In one embodiment, the transmission power used by the macro cell radio to drive signals on the antenna 110 may be greater than the transmission power used by the micro cell radio. As a result, the distance the radiation pattern 300 extends is larger than the radiation pattern of the micro cell antenna.

Figure 4:
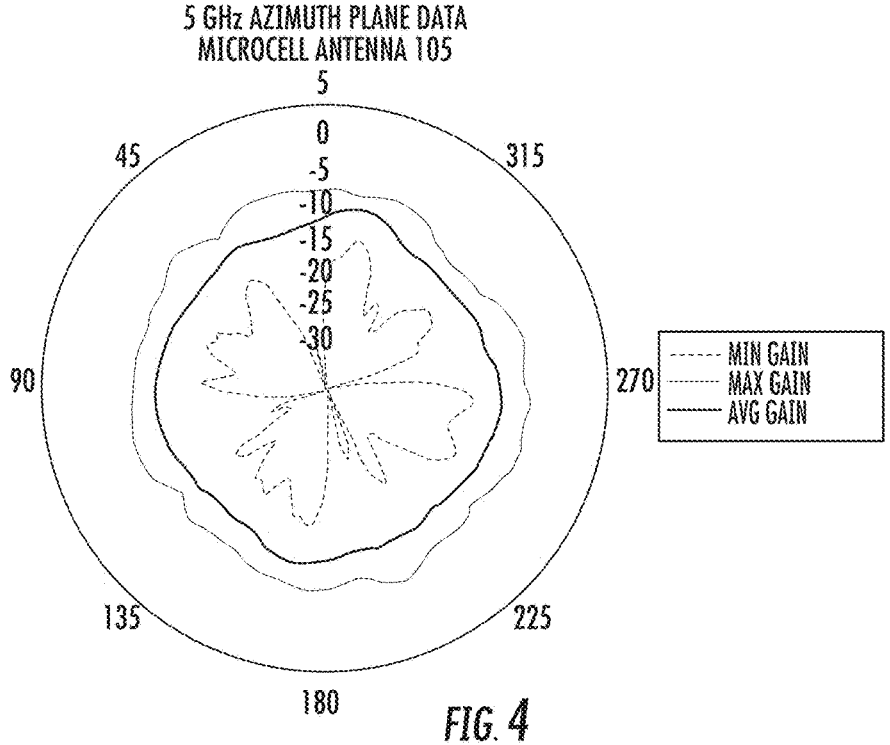
FIG. 4 illustrates the radiation pattern of a micro cell antenna along the azimuth plane, according to one embodiment described herein.

FIG. 4 illustrates the radiation pattern 400 of the micro cell antenna 105 along the azimuth plane, according to one embodiment described herein. Like the macro cell antenna 110 shown in FIG. 3, the average gain of the micro cell antenna 105 is omnidirectional. However, the typical gain of the micro cell antenna 105 is generally less than the macro cell antenna 110 which results in the coverage area of the micro cell being smaller than the coverage area of the macro cell along the azimuth plane.

Figure 5:
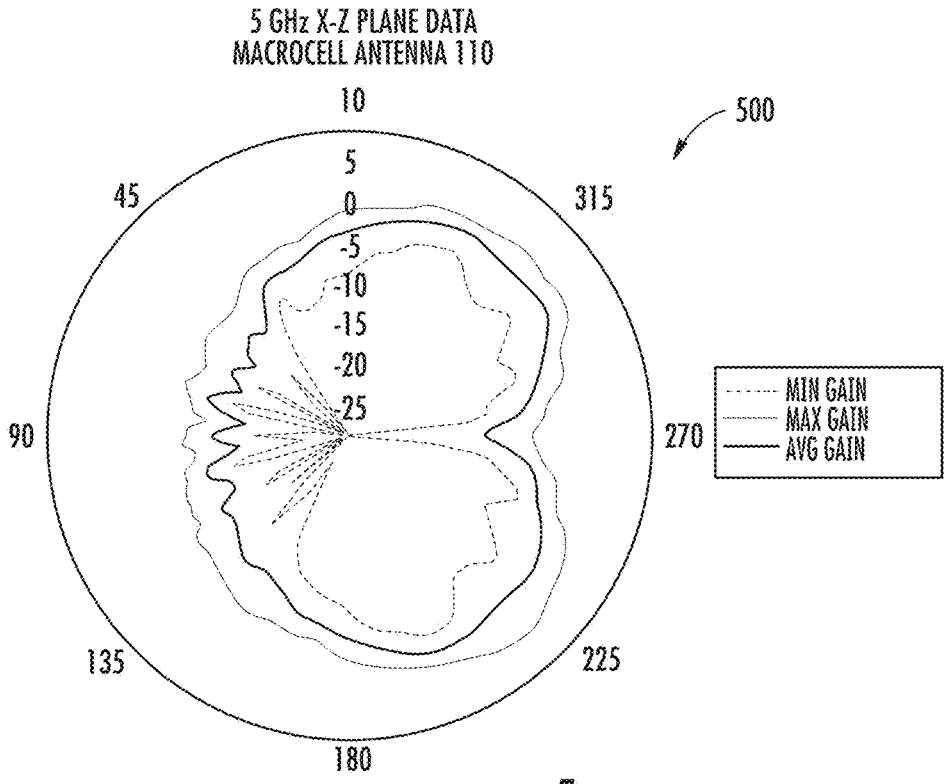
FIG. 5 illustrates the radiation pattern of a macro cell antenna along the elevation plane, according to one embodiment described herein.

FIG. 5 illustrates the radiation pattern 500 of the macro cell antenna 110 along the elevation plane, according to one embodiment described herein. The elevation plane (i.e., the X-Z plane) is orthogonal to the azimuth plane where the horizontal axis of the radiation pattern 500 extends from below the network device (again assuming the device is mounted on the ceiling where the ground plane is in a facing relationship with the floor) to above the network device. As shown by the average gain, most of the gain is in the right side of the radiation pattern 600—i.e., below the ceiling in a direction towards the floor.

Moreover, the radiation pattern 500 of the antenna 110 has reduced gain immediately below the network device—i.e., around 270 degrees. When a client is below the network device, the client can access point proximity (high client SNR) to achieve satisfactory performance. In general, the closer a client is to the access point, the higher the supported data rate (better performance). Thus, the antenna 110 provides excellent coverage along the horizon if mounted on the ceiling as shown by FIG. 3.

Figure 6:
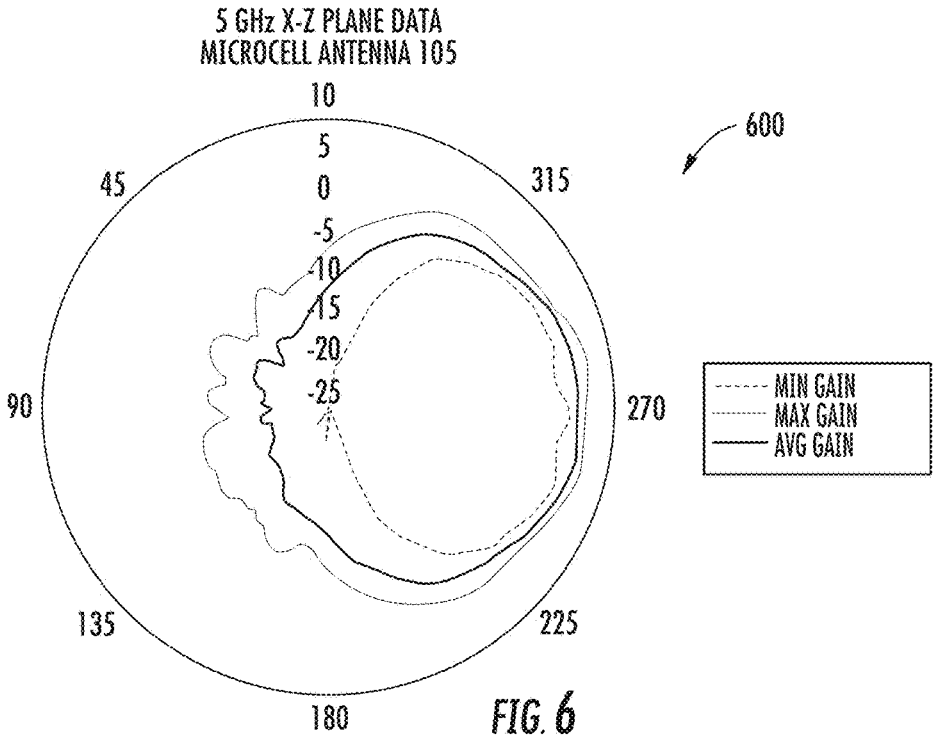
FIG. 6 illustrates the radiation pattern of a micro cell antenna along the elevation plane, according to one embodiment described herein.

FIG. 6 illustrates the radiation pattern 600 of the micro cell antenna 105 along the elevation plane, according to one embodiment described herein. Unlike antenna 110, the micro cell antenna 105 has excellent gain in the right half of the radiation pattern 600. Thus, when mounted on the ceiling, the micro cell antenna 105 provides excellent coverage for client devices that are directly below or near the network device. As shown, relatively little of the radiation pattern 600 is in the left side of the radiation pattern 600, and thus, the gain of the antenna 105 above the ceiling is small. As such, the micro cell antenna 105 is well suited for establishing a micro cell with a coverage area close to the network device while the macro cell antenna 110 establishes a macro cell with a coverage area that extends further away from the network device—i.e., towards the horizon.

Figure 7:
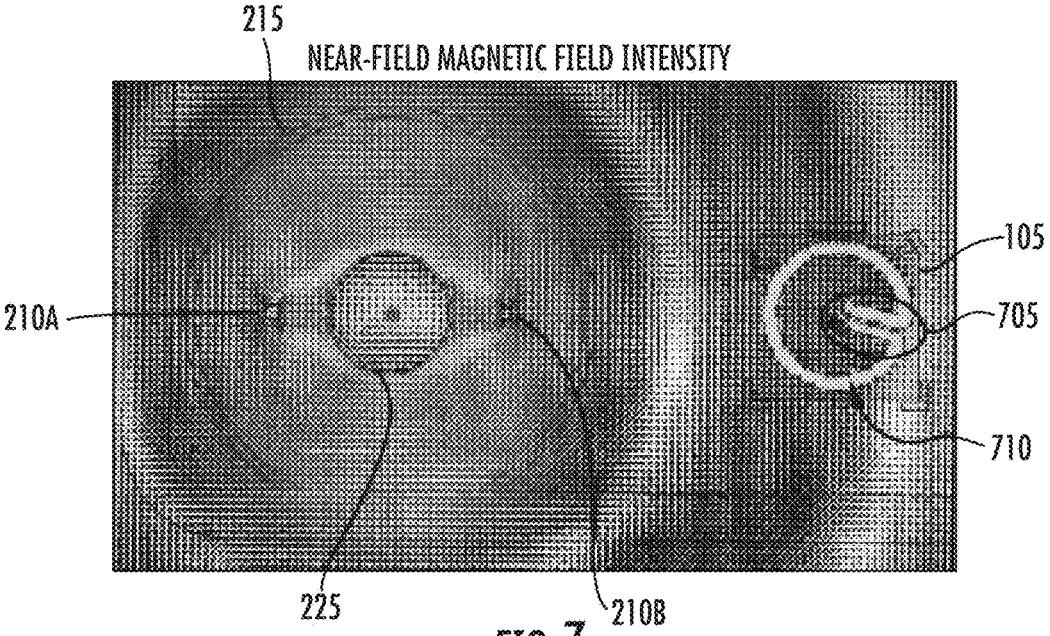
FIG. 7 illustrates the magnetic field intensity resulting from transmitting on the macro cell antenna, according to one embodiment described herein.

FIG. 7 illustrates the near-field magnetic field intensity resulting from transmitting on the macro cell antenna 110, according to one embodiment described herein. Specifically, FIG. 7 illustrates the magnetic field intensity generated by the macro cell antenna 110 and its effect on the neighboring micro cell antenna 105. As shown, driving a current in the macro cell antenna 110 generates magnetic field vectors in the plane of the table portion 215 of the antenna. Because the shorting legs 210A and 210B generate large currents flowing into and out of the page, these currents generate a magnetic field that circles around the antenna 110 as shown in FIG. 7. Put differently, the shorting legs 210 create two short circuits between the table portion 215 of the antenna 110 to the ground plane. These short circuits generate strong magnetic fields that circle around the antenna 110 which resemble the magnetic field circling an electric monopole antenna.

The micro cell antenna 105 includes a strip slot 705 which extends from the center of the antenna 105 to the loop 710. The loop 710 establishes a conductive path in which current can flow along a plane that is parallel to the table portion 215 in the antenna 110 and the ground plane. However, magnetic fields induce currents that are on planes that are orthogonal to the magnetic fields. Because the loop 710 establishes a current path that is parallel, rather than orthogonal, to the plane of the magnetic field, the instantaneous magnetic field intensity shown in FIG. 7 does not generate much current or signal on the micro cell antenna 105. Thus, the interfering noise received by the micro cell radio due to the micro cell antenna 105 receiving signals emitted by the macro cell antenna 110 is reduced. Put differently, the design of the macro and micro cells antennas 110, 105 isolate these antennas from one another.

Figure 8:
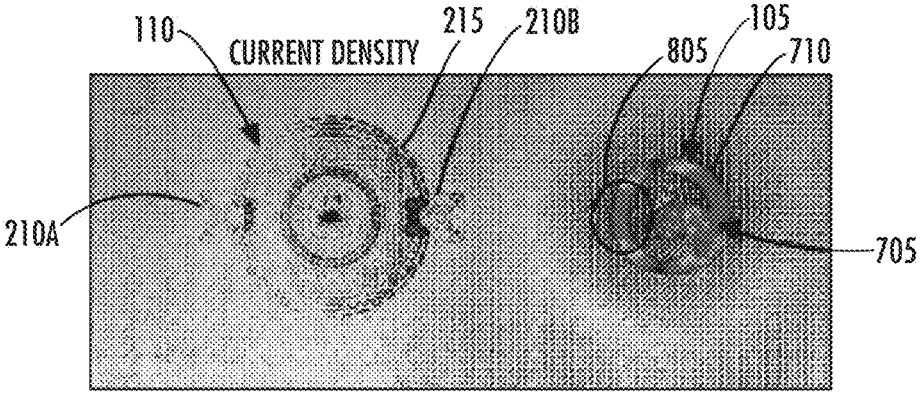
FIG. 8 illustrates the current density resulting from transmitting on the micro cell antenna, according to one embodiment described herein.

FIG. 8 illustrates the current density resulting from transmitting on the micro cell antenna, according to one embodiment described herein. The darker portions of FIG. 8 illustrate the locations of higher current density while the lighter portions indicate portions of less current density. In the micro cell antenna 105, the larger current density is found where the strip slot 705 meets the loop as well as the opposite side of the loop 710. However, as shown by portion 805 of the loop 710, the greatest current density is not directly across from where the strip slot 705 meets the loop 710 but is slightly off centered.

Because of the location of the high current density portion 805 in the loop 710, the loop 710 is slightly rotated about 10-20 degrees (e.g., 15 degrees in this example) such that portion 805 is in line with the shorting legs 210A and 210B of the macro cell antenna 110. That is, if a straight plane or line is drawn through the shorting legs 210 extending from left to right across FIG. 8, the loop 710 is rotated such that this plane/line passes though the high current density portion 805 and the center of the antenna 105. That way, the micro cell antenna's radiating edge shown by portion 805 is aligned with the $TM_{20}$ mode patch's shorting leg 210B, which sources the strongly circulating magnetic field.

This logic follows from the Biot-Savart law where the magnetic vector potential is in the same direction as the current source. More particularly, the magnetic field intensity is orthogonal to the magnetic vector potential at all points in space, which implies that the magnetic field intensity is orthogonal to any source current density. In this example, the Biot-Savart law is applied to produce orthogonal vector potentials. The maximum mutual coupling at a fixed distance occurs when the near-field magnetic field modes are aligned. Using the arrangement of the micro and macro cell antennas 105, 110 shown in FIGS. 7 and 8, the maximum coupling to antenna 105 is forced to be in a direction perpendicular to the circulating magnetic field of the macrocell antenna by placing the electric currents that align with the macro cell antenna's magnetic field. Moreover, the high current point in portion 805 of the micro cell antenna 105 and the high magnetic field point at shorting leg 210B of the macro cell antenna 110 are aligned by slightly rotating the micro cell antenna 105 such that a connection point where the strip slot 705 couples to the loop 710 is 15 degrees off of the plane extending from the shorting legs 210 through the center of the micro cell antenna 105.

Moreover, FIG. 8 illustrates that the electromagnetic signals emitted by the micro cell antenna 105 generate minimal currents on the macro cell antenna 110. Thus, the signals transmitted by the micro cell antenna 105 have reduced negative impact on the macro cell radio which is receiving signals using the macro cell antenna 110.

Figure 9:
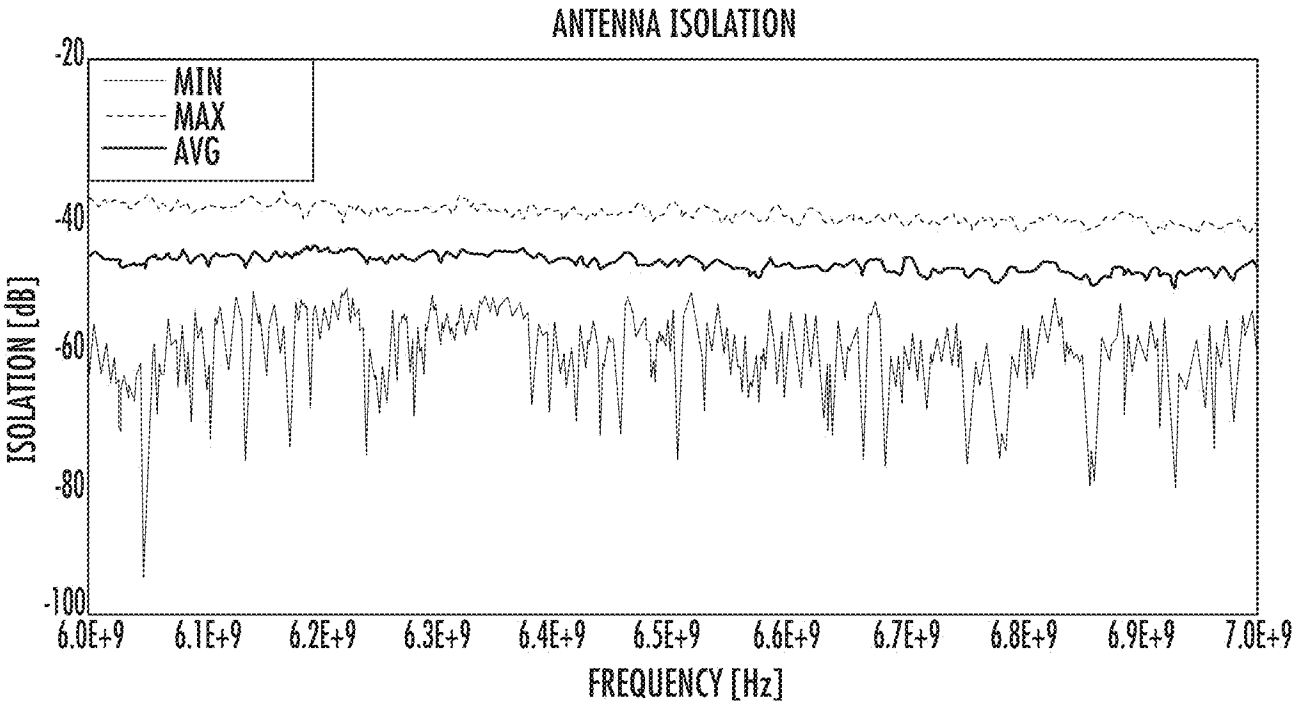
FIG. 9 illustrates the isolation between a micro cell antenna and macro cell antennas in the network device, according to one embodiment described herein.

FIG. 9 illustrates the isolation between the micro cell antenna 105 and the macro cell antennas 110 in the network device, according to one embodiment described herein. Specifically, FIG. 9 is an aggregate plot of the mutual coupling between the micro and macro cell antennas where the average mutual coupling across 5-6 GHz (shown by the middle trace) is 43 dB between any two macro cell antennas and a micro cell antenna, thereby achieving significant isolation between the micro and macro cell antennas. Moreover, the micro-to-micro antenna isolation may be around 40 dB.

As described above, isolating macro and micro cell antennas grouped in the same pair is achieved by ensuring the magnetic field generated by the macro cell antenna is not orthogonal to the direction of current in the micro cell antenna. Explained a different way, in one embodiment, the macro cell antenna is vertically polarized while the micro cell antenna (also called a horizontal pol) is horizontally polarized. An isolated antenna with a high horizontal polarization will have high isolation when operating with an antenna with a high vertical polarization for a given gain/distance. The far-field electrical and magnetic fields emitted by a horizontally polarized antenna are rotated ninety degrees relative to the electrical and magnetic fields emitted by a vertically polarized antenna. As described above, this results in high isolation between the macro and micro cell antennas in any given pair.

Moreover, the 43 dB isolation shown in FIG. 9 is also achieved by the spatial separation of the macro and micro cell antennas as shown in FIG. 1. That is, because the macro and micro cell antennas are grouped in pairs in respective corners of the network device, this increases the distance between pairs relative to an arrangement where the micro cell antennas are equidistant between two or more of the macro cell antennas.

However, although the micro cell antennas are horizontally polarized relative to the neighboring macro cell antennas, this is not the case relative to a client device that is communicating with the network device. Referring back to FIG. 1, each of the micro cell antennas 105 is rotated ninety degrees on the ground plane 115 relative to its neighboring micro cell antenna 105. That is, as you move in a clockwise or counterclockwise direction, each of the micro cell antennas 105 has a rotational orientation that is rotated ninety degrees relative to the next neighboring micro cell antenna 105. Thus, from the perspective of a client device facing the ground plane 115, two of the micro cell antennas 105 (e.g., antennas 105A and 105C) have one polarization while the other two antennas 105 (e.g., antennas 105B and 105D) have the opposite polarization. Although rotating the micro cell antennas 105 as shown is not necessary, doing so may improve multiple-input and multiple-output (MIMO) communication between the micro cell and client devices. In one embodiment, establishing multiple polarizations from the perspective of the client device using the micro cell antennas 105 allows more MIMO diversity.

Figure 10:
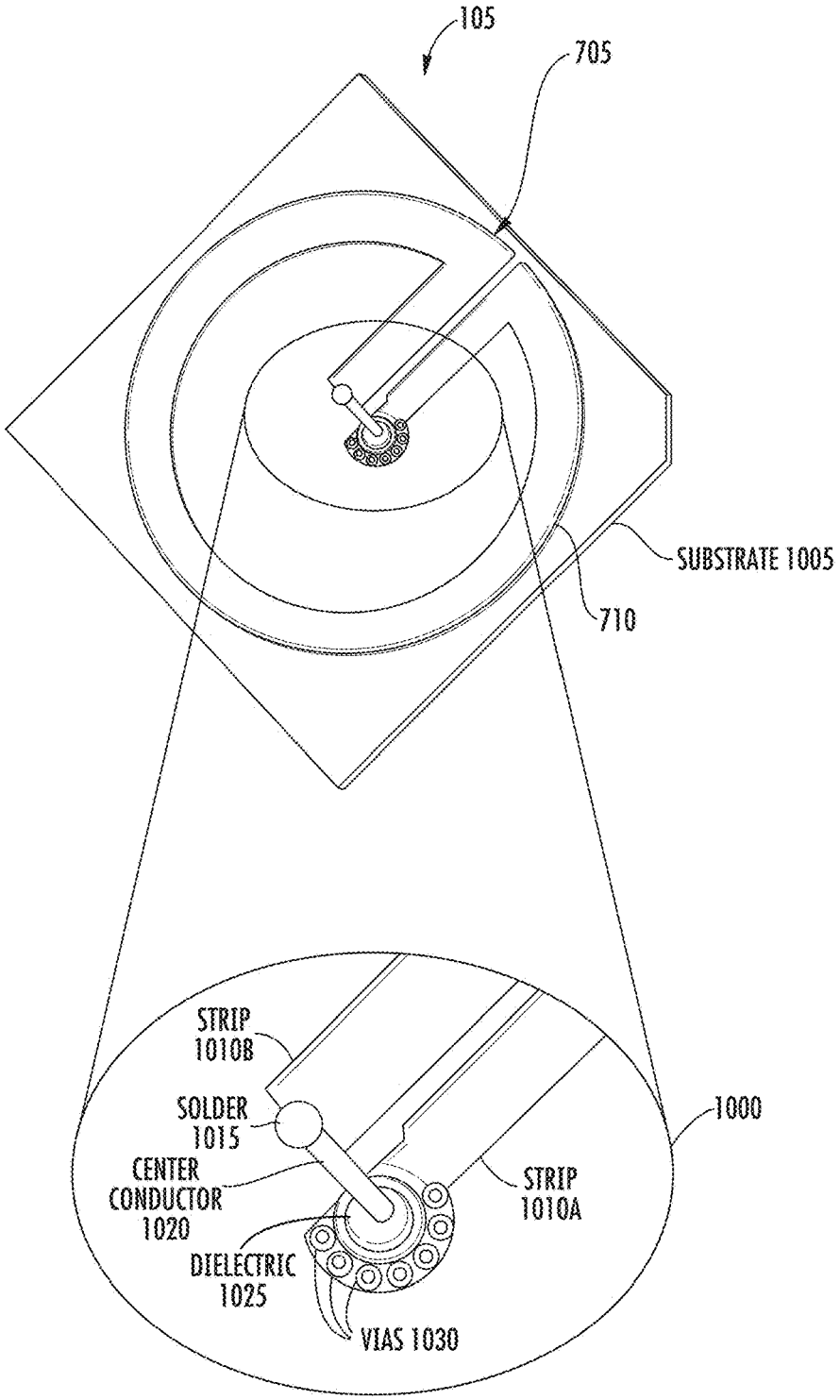
FIG. 10 illustrates a micro cell antenna in the network device, according to one embodiment described herein.

FIG. 10 illustrates the micro cell antenna 105 in the network device, according to one embodiment described herein. Specifically, FIG. 10 illustrates a front side of the micro cell antenna 105 in FIG. 10. In this embodiment, the micro cell antenna 105 includes a substrate 1005 on which the strip slot 705 and loop 710 are disposed. In one embodiment, the substrate 1005 is a printed circuit board (PCB) such as FR-4 PCB where a conductive layer (e.g., a copper layer) is etched to form the strip slot 705 and loop 710. In one embodiment, the diameter of the loop 710 is approximately 15.5 mm. Moreover, one of the corners of the substrate 1005 is chamfered which can be used to correctly orient the micro cell antenna 105 when coupled to the radome. Referring back to FIG. 2, the chamfered corner ensures that the technician assembling the network device can attach the fasteners in the radome only in one orientation so that the micro cell antenna is correctly aligned with the macro cell antenna to result in the benefits described above.

The blowout image 1000 illustrates the details of the center of the micro cell antenna 105. As shown, the strip slot 705 includes a first strip 1010A and a second strip 1010B. The first strip 1010A is electrically coupled to vias 1030 which extend through the substrate 1005 to a conductive pad or sheet located on a different surface of the substrate 1005. For example, the vias 1030 can couple to a ground pad the opposite surface of the substrate 1030 that surrounds a through-hole through which the dielectric 1025 and center conductor 1020 extend. As described in more detail below, the conductive pad is coupled to the shielding conductor of a coaxial cable that couples the micro cell antenna 105 to the micro cell radio. Moreover, the strip 1010A partially surrounds a hole or aperture in the substrate 1005 through which a dielectric 1025 and a center conductor 1020 of the coaxial cable extend. Because of the dielectric 1025, the first strip 1010A is not electrically coupled to the center conductor 1020 of the coaxial cable. Instead, the center conductor 1020 extends through the hole in the substrate 1005 and is bent towards the second strip 1010B. Using solder 1015, the center conductor 1020 is electrically coupled to the second strip 1010B. In this manner, the first strip 1010A is electrically connected to the shielding conductor of the coaxial cable while the second strip 1010B is electrically connected to the center conductor 1020 of the coaxial cable.

In one embodiment, the width of the strips 1010A and 1010B is tuned to match the input impedance of the full wave loop 710 to a predefined reference impedance (e.g., 50 ohms). The current distribution in the loop 710 is similar to two in-phase dipoles spaced a quarter wavelength apart, and as a result, the micro cell antenna 105 is an efficient broadside radiator. Put differently, the antenna 105 has a radiation pattern that is well suited for serving clients located below a network device mounted on a ceiling.

By generating an alternating voltage potential between the center conductor 1020 and shielding conductor in the coaxial cable, current is generated through the strip slot 705 and the loop 710. This current radiates electromagnetic waves that can be used to establish the micro cell and communicate with client devices as described above.

Figure 11:
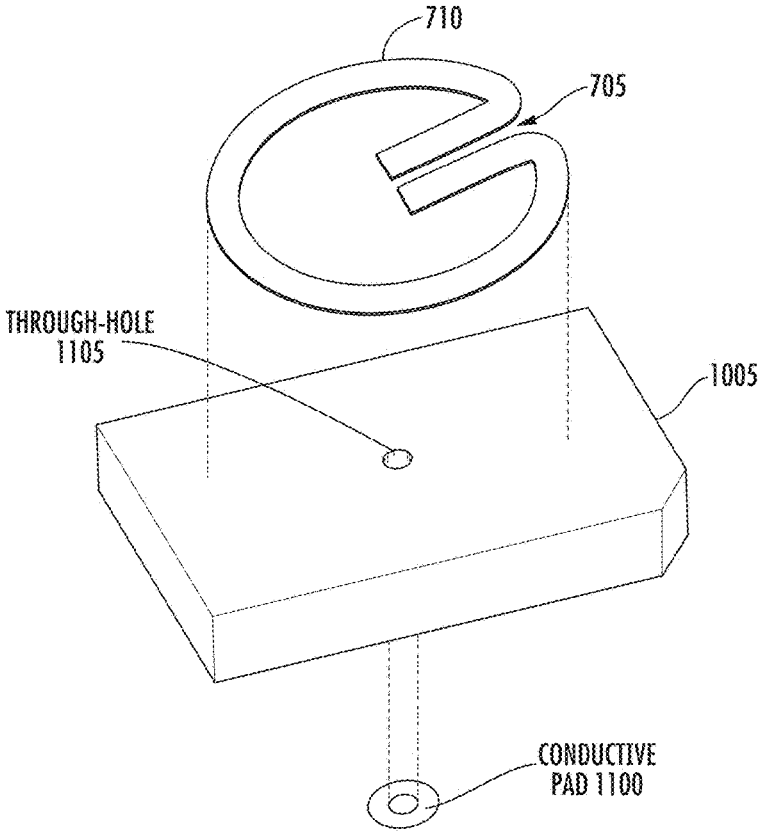
FIG. 11 illustrates an exploded view of a printed micro cell antenna, according to one embodiment described herein.

FIG. 11 illustrates an exploded view of a printed micro cell antenna, according to one embodiment described herein. As shown, the strip slot 705 and loop 710 are formed from a single conductive material (e.g., copper) although in other embodiments these features may be formed using different conductive materials. The strip slot 705 and loop 710 may be disposed on the substrate 1005.

A conductive pad 1100 (e.g., a copper pad) is disposed on a different surface of the substrate 1005. As described above, the shielding conductor of the coaxial cable is connected to the conductive pad 1100. Although not shown in FIG. 11, the substrate 1005 includes vias that electrically couple the conductive pad 1100 to one of the strips in the strip slot 705. The substrate 1005 and conductive pad 1100 both include respective through-holes 1105 which permit the center conductor of the coaxial cable to pass through these layers and bond to one of the strips in the strip slot 705. The through-holes 1105 may be designed such that the center conductor is electrically insulated from both the conductive pad 1100 and the slot electrically coupled to the conductive pad 1100 by the vias.

Figure 12:
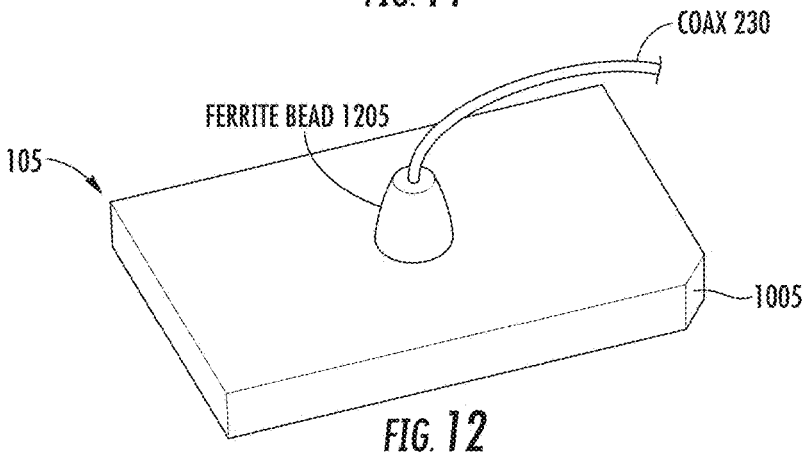
FIG. 12 illustrates coupling a printed micro cell antenna to the network device, according to one embodiment described herein.

FIG. 12 illustrates coupling the micro cell antenna 105 to the micro cell radio, according to one embodiment described herein. Specifically, FIG. 12 illustrates a back side of the micro cell antenna 105 opposite the front side shown in FIG. 10. In one embodiment, when assembled, the back side of the micro cell antenna 105 is in a facing relationship with the ground plane 115 shown in FIG. 1. The front side of the micro cell antenna 105 (which includes the loop and strip slot) is in a facing relationship with the radome of the network device. A technician may mount the network device in the ceiling or on a wall so that the radome and the front side of the micro cell antenna 105 faces away from the ceiling or the wall while the back side of the antenna 105 faces the structure on which the network device is mounted.

In one embodiment, the micro cell antenna 105 operates only in the 5 GHz band and does not switch to different communication bands (e.g., 2.4 GHz WiFi, Bluetooth, WiMAX, etc.). However, the macro cell antennas in the network device may switch between bands—e.g., between 2.4 GHz and 5 GHz. Because of 2.4 GHz electromagnetic signals have different wavelengths than 5 GHz electromagnetic signals, the behavior of the micro cell antenna 105 varies relative to the signals emitted by the macro cell antenna. As described above, when the macro cell antenna transmits 5 GHz signals, the portion of the micro cell antenna 105 with the highest current density is aligned with the point in the macro cell antenna sourcing the strong magnetic field which means 43 dB isolation can be obtained between the micro and macro cell antennas. However, when the macro cell antenna transmits 2.4 GHz signals, the loop in the micro cell antenna acts like a short circuit, which means that signals emitted by the macro cell antenna can be conducted into the radio area of the chassis on the shield of the microcell antenna's coaxial cable.

To mitigate this interference, the coaxial cable 230 extends through a ferrite bead 1205 (also can be referred to as a choke). Generally, the ferrite bead 1205 has a resistance that changes according to the frequency of the signal. In one embodiment, the ferrite bead 1205 has a greater resistance at lower frequencies (e.g., 2.4 GHz) than higher frequencies (e.g., 5 GHz) and, for example, has a resonant frequency at 1 GHz. For example, the ferrite bead 1205 attenuates 2.4 GHz signals more than 5 GHz signals. Because the micro cell antenna is designed to transmit and receive at 5 GHz, when the macro cell antenna transmits the 2.4 GHz signals, the micro cell antenna may behave in an undesired manner. For example, the 2.4 GHz signal transmitted by the macro cell antenna may be received along the strip 1010A shown in FIG. 10. Because strip 1010A is coupled to the vias 1030 which are in turn coupled to the shield conductor of the coaxial cable, this means the 2.4 GHz signals are introduced into the shield conductor. The ferrite bead 1205 attenuates these signals on the shield conductor (which are undesired). Thus, although the ferrite bead 1205 may slightly compromise the performance of the micro cell when receiving and transmitting 5 GHz signals, the tradeoffs are small and are outweighed by the ability of the ferrite bead 1205 to attenuate undesired out-of-band signals on the shield conductor, eliminate voltage standing wave ratio (VSWR) resonances, and attenuate the current on the shielding conductor of the coaxial cable 230. However, if the macro cell antenna transmits signals only in the same band as the micro cell antenna 105 (e.g., 5 GHz), then the ferrite bead 1205 may be omitted from the antenna 105.

In one embodiment, the micro cell antenna has an eyelet that includes an annular surface forming a hole and a cylindrical surface disposed around the circumference of the hole and extends in a direction away from the annular surface. The annular surface can be soldered onto the conductive pad 1100 coupled to the vias 1030 and the first strip 1010A shown in FIG. 10 which aligns the cylindrical surface to the through-hole 1105 illustrated in FIG. 11. Moreover, a portion of the shield conductor on the coaxial cable is exposed such that when the coaxial cable is placed in the cylindrical surface (and the through-hole 1105), the shield conductor is soldered to the cylindrical surface thereby electrically coupling the shield conductor of the coaxial cable to the conductive pad 1100, the vias 1030 and the first strip 1010A. The ferrite bead 1205 can then be slid over the cylindrical surface of the eyelet. In this manner, the eyelet facilitates efficient electrical coupling between the shielding conductor of the coaxial cable 230 to the conductive pad 1100. However, in other embodiments, the shielding conductor in the coaxial cable 230 may be directly bonded, e.g., using solder, to the conductive pad 1100 after the coaxial cable 230 extends through the ferrite bead 1205.

In one embodiment, an end of the cylindrical surface of the eyelet facing away from the substrate 1005 is flared. Thus, when the ferrite bead 1205 is slide over the cylindrical surface of the eyelet, the flared portion creates a press fit that holds the ferrite bead in place on the eyelet. Put differently, after the ferrite bead 1205 is slid past the flared portion of the cylindrical surface, the flared portion prevents the ferrite bead 1205 from sliding away from the substrate 1005. In this example, the ferrite bead 1205 may not need to be adhesively bonded to the micro cell antenna.

Figure 13:
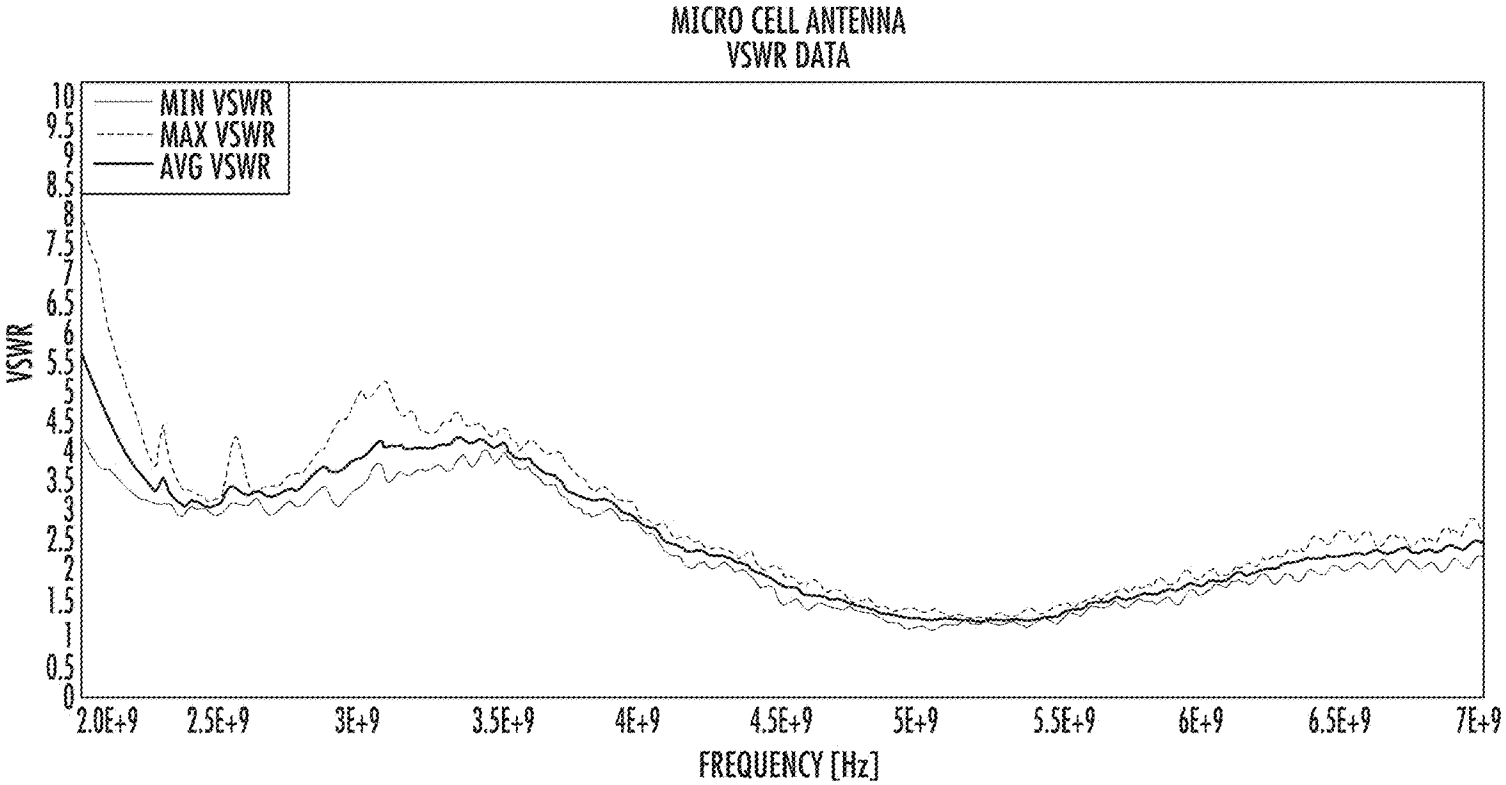
FIG. 13 illustrates VSWR data for the micro cell antenna, according to one embodiment described herein.

FIG. 13 illustrates the VSWR values for the micro cell antenna, according to one embodiment described herein. As shown, the performance of the micro cell antenna 105 is substantially between 1.5:1 and 2:1 in the 5150-5875 MHz range.

In the preceding, reference is made to embodiments presented in this disclosure. However, the scope of the present disclosure is not limited to specific described embodiments. Instead, any combination of the described features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

As will be appreciated by one skilled in the art, the embodiments disclosed herein may be embodied as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium is any tangible medium that can contain, or store a program for use by or in connection with an instruction execution system, apparatus or device.

Computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

In view of the foregoing, the scope of the present disclosure is determined by the claims that follow.

We claim:

1. A network device, comprising:

a chassis;

a first antenna disposed in the chassis, wherein the first antenna has a first polarization and comprises a conductive loop having a first strip and a second strip, wherein the first strip and the second strip are coplanar with the conductive loop in a first plane and extend to a center of the first antenna, wherein the first strip is coupled at a first end to a first radio via a shielding conductor of a coaxial cable and is coupled at a second end to the conductive loop, and the second strip is coupled to the first radio at a first end via a center conductor of the coaxial cable and is coupled at a second end to the conductive loop; and a second antenna disposed in the chassis and coupled to a second radio, wherein the second antenna has a second polarization different from the first polarization, and wherein the second antenna comprises a planar table portion disposed along a second plane and a bucket coupled to the planar table portion, wherein the bucket extends in a direction perpendicular to the second plane.

2. The network device of claim 1, wherein the second antenna comprises a planar table portion and a bucket centered in the planar table portion.

3. The network device of claim 2, wherein the first plane is substantially parallel to the second plane containing the planar table portion.

4. The network device of claim 2, wherein the second antenna comprises two shorting legs extending from the table portion to a ground plane in the network device, wherein the two shorting legs are coupled to diametrically opposed locations on the table portion.

5. The network device of claim 4, wherein the center of the first antenna lies along a line that extends through the two shorting legs, and wherein the first antenna is rotated such that the first strip and the second strip are rotated 10-20 degrees away from the line.

6. The network device of claim 1, further comprising:

a plurality of micro cell antennas coupled to the first radio, wherein the plurality of micro cell antennas includes the first antenna;

a plurality of macro cell antennas coupled to the second radio, wherein the plurality of macro cell antennas includes the second antenna, wherein a coverage area of a macro cell established by the plurality of macro cell antennas is spatially larger than a coverage area of a micro cell established by the plurality of micro cell antennas, and wherein the coverage area of the macro cell encloses the coverage area of the micro cell.

7. The network device of claim 6, wherein wherein each one of the plurality of micro cell antennas is closer to a respective one of the plurality of macro cell antennas than all the remaining macro cell antennas.

8. The network device of claim 6, wherein the plurality of micro cell antennas are rotated to each other relative to a ground plane in the network device.

9. The network device of claim 8, wherein, relative to a client device located at a distance from the network device, a first one of the plurality of micro cell antennas has a third polarization that is different from a fourth polarization of a second one of the plurality of micro cell antennas due to relative rotational orientations of the first one of the plurality of micro cell antennas and the second one of the plurality of micro cell antennas.

10. A network device, comprising:

a chassis;

a first plurality of antennas disposed in the chassis and coupled to a first radio, wherein each of the first plurality of antennas comprises a conductive loop having a first strip and a second strip, wherein the first strip and the second strip are coplanar with the conductive loop and extend from the conductive loop to a center of a respective one of the first plurality of antennas, wherein the first strip is coupled at a first end to the first radio via a shielding conductor and is coupled at a second end to a first connection point of the conductive loop, and wherein the second strip is coupled at a first end to the first radio via a center conductor and is coupled at a second end to a second connection point of the conductive loop; and a second plurality of antennas disposed in the chassis and coupled to a second radio, wherein each of the second plurality of antennas comprises a planar table portion disposed along a first plane and a bucket coupled to the planar table portion, wherein the bucket extends in a direction perpendicular to the first plane.

11. The network device of claim 10, wherein the bucket is centered in the planar table portion of each of the second plurality of antennas.

12. The network device of claim 10, wherein the conductive loop lies in a second plane that is substantially parallel to the first plane containing the planar table portion.

13. The network device of claim 10, wherein each of the second plurality of antennas comprises two shorting legs extending from the planar table portion to a ground plane in the network device, wherein the two shorting legs are coupled to diametrically opposed locations on the planar table portion.

14. The network device of claim 13, wherein respective centers of each of the first plurality of antennas lie along respective lines that extend through the respective shorting legs of one the second plurality of antennas, and wherein each of the first plurality of antennas is rotated such that the first strip and the second strip are rotated 10-20 degrees away from the respective lines.

15. The network device of claim 10, wherein each of the first plurality of antennas has a first polarization that is different from a second polarization of respective one of the second plurality of antennas.

16. The network device of claim 15, wherein each of the first plurality of antennas is closer to a respective one of the second plurality of antennas than all the remaining second plurality of antennas.

17. The network device of claim 10, wherein the first plurality of antennas are rotated to each other relative to a ground plane in the network device.

18. The network device of claim 17, wherein, relative to a client device located at a distance from the network device, a first antenna of the first plurality of antennas has a third polarization that is different from a fourth polarization of a second antenna of the first plurality of antennas due to relative rotational orientations of the first and second antennas.

19. A network device, comprising:

a chassis;

a first plurality of antennas disposed in the chassis and coupled to a first radio, wherein each of the first plurality of antennas comprises a conductive loop having a first strip and a second strip, wherein the first strip and the second strip are coplanar with the conductive loop, wherein the first strip is coupled to the conductive loop at a first end and extends to a center of the conductive loop to a second end that is coupled to a shielding conductor of a coaxial cable couple with the first radio, and wherein the second strip is coupled to the conductive loop at a first end and extends to the center of the conductive loop to a second end that is coupled to the center conductor of the coaxial cable coupled at two ends to respective strips of a strip slot, wherein the strip slot extends from the loop to a center of a respective one of the first plurality of antennas; and a second plurality of antennas disposed in the chassis and coupled to a second radio, wherein each of the second plurality of antennas is a transverse magnetic 20 ($TM_{20}$) mode patch antenna.

20. The network device of claim 19, wherein each of the second plurality of antennas comprises a planar table portion disposed along a first plane and a bucket coupled to the planar table portion, wherein the bucket extends in a direction perpendicular to the conductive loop.

* * * * *